United States Patent [19]

Lawson

[11] 4,432,670

[45] Feb. 21, 1984

[54] COMBINATION CONNECTOR AND FLEX JOINT FOR UNDERWATER TENSION ELEMENTS

[75] Inventor: John E. Lawson, London, England

[73] Assignee: Armco Inc., Middletown, Ohio

[21] Appl. No.: 192,739

[22] Filed: Oct. 1, 1980

[51] Int. Cl.[3] ..... E02D 5/74; E02B 17/00; F16L 27/04; F16L 27/10

[52] U.S. Cl. ..... 405/224; 405/202; 405/195; 285/223; 285/263

[58] Field of Search ..... 405/202, 224, 195; 285/223, 261, 263; 166/355; 175/7

[56] References Cited

U.S. PATENT DOCUMENTS

| | | | |
|---|---|---|---|
| 3,479,061 | 11/1969 | Smookler et al. | 285/263 X |
| 3,680,895 | 8/1972 | Herbert et al. | 285/261 X |
| 3,791,442 | 2/1974 | Watkins | 166/355 X |
| 4,098,341 | 7/1978 | Lewis | 175/195 X |
| 4,173,360 | 11/1979 | Bergman et al. | 285/223 X |
| 4,183,556 | 1/1980 | Schwemmer | 285/263 X |
| 4,319,773 | 3/1982 | Lawson | 285/321 X |
| 4,320,993 | 3/1982 | Hunter | 405/224 |

*Primary Examiner*—Stephen J. Novosad
*Assistant Examiner*—Nancy J. Pistel
*Attorney, Agent, or Firm*—Roylance, Abrams, Berdo & Farley

[57] ABSTRACT

Combination tension connector and flex joint for underwater tension elements, such as the tension elements of a leg of a tension leg platform. The flex joint is of generally ball and socket type, with the ball member connected to the lower end of the tension element and the socket member connected to an upwardly projecting annular portion of the male member of the connector.

17 Claims, 4 Drawing Figures

COMBINATION CONNECTOR AND FLEX JOINT FOR UNDERWATER TENSION ELEMENTS

The invention provides a combined remotely operated connector and flex joint for underwater tension elements and is particularly useful for securing tension elements of the legs of tension leg platforms to an anchoring base on the floor of a body of water.

RELATED APPLICATIONS

One embodiment of the remotely operated connector employed in this invention is disclosed and claimed in copending application Ser. No. 170,970 filed July 18, 1980, by Edward M. Galle, Jr. A split ring fastener employed in this invention to interconnect components of the combined connector and flex joint is disclosed and claimed in copending application Ser. No. 120,046, filed Feb. 11, 1980, by John E. Lawson now U.S. Pat. No. 4,319,773.

BACKGROUND OF THE INVENTION

Need for drilling and completing oil and gas wells offshore in increasing numbers and at increasing depths has accentuated the problem of installing tension elements in the nature of strings of pipe extending from, e.g.,. a platform at the surface to, e.g., an anchoring base on the ocean floor, with the tension element being capable of withstanding the large lateral forces applied by water currents and waves, yet being readily retrievable by remote manipulations without the aid of divers. One specific example of such installations is presented by the tension leg platform in which each of a plurality of legs may involve, e.g., three tension elements each in the form of a string of pipe, with each tension element capable of withstanding a tension load in excess of 6 million pounds. While providing a remotely connectable and releasable coupling for such a tension element is in itself a challenging task, it has been recognized from the outset that the overall problem is complicated by the need for equipping the tension element with a flex joint to accommodate the large lateral forces applied by the water through which the tension element extends. During early planning for tension leg platforms, prior art workers have been content merely to specify that each tension element must be connected to an anchoring base by a remotely operated connector, so that initial connection of the tension element to the anchoring base can be accomplished from the surface and the tension element can subsequently be disconnected and recovered for periodic inspection, and that a flex joint be installed in the tension element adjacent the connector. However, in arriving at a feasible actual embodiment of the tension leg and connector, it has been discovered that merely providing both a connector and a flex joint cannot answer the problem satisfactorily because the lateral forces and bending moments would be applied via the flex joint to the mating load-bearing surfaces of the connector. The problem has been made more critical by the fact that, at the time of this application, no tension leg platform has ever been installed, and the past experience with more conventional anchoring systems and in providing connectors for, e.g., underwater wellhead bodies, well casing, piling and the like is largely environmental, rather than specific, to the problems presented by remote installation of the pipe strings forming a leg of a tension leg platform.

OBJECTS OF THE INVENTION

One object of the invention is to provide a combined connector and flex joint in which the male member of the connector cooperates directly with both the ball and the socket of the flex joint.

Another object is to devise a combined remotely operable connector and flex joint in which there is a metal-to-metal connection between the male connector body and the string of pipe or other tension element in such fashion that presence of the yieldable material in the flex joint does not interfere with making up of the connector.

A further object is to provide a combined connector and flex joint which is compact, yet capable of sustaining very large tension loads and compensating for large transverse forces.

Yet another object is to provide such a device in which lateral forces applied via the flex joint are transferred to the female connector member in locations above and below the load-bearing shoulders of the connector rather than solely in the location of the load-bearing shoulders.

A still further object is to provide such a device in which presence of the flex joint does not adversely affect dependable remote operation of the connector.

SUMMARY OF THE INVENTION

Devices according to the invention comprise a male connector member equipped with load-bearing shoulders, typically presented by a split ring or an annular set of segments, adapted to coact with mating shoulder means on a female connector member; and a flex joint comprising a rigid ball member adapted to be connected rigidly to the lower end of the pipe string, a rigid socket member connected to the upper end of the male connector member, and elastomeric means operatively disposed between the ball and socket members. The body of the male connector member includes an upwardly projecting annular portion which embraces the socket member of the flex joint, the load-bearing shoulders, annular upper end portion and ball and socket members of the flex joint all being coaxial when the connector is made up and the flex joint undistorted. The rigid ball means of the flex joint and the male connector member have interengaged spherical bearing surfaces so disposed that a force applied downwardly via the pipe string is imparted directly to the male connector member through metal-to-metal contact independent of the elastomeric means of the flex joint. Advantageously, the male connector member includes an intermediate portion and a lower end portion, the annular portion projecting upwardly from the intermediate portion, the load-bearing shoulders being carried by the intermediate portion. In such embodiments, lateral forces applied via the flex joint are transferred to the female connector member, via the male connector member, in locations above and below the load-bearing shoulders so as to minimize effects of such lateral forces on the interengaged load-bearing shoulders.

In other embodiments, the load-bearing shoulders are carried, e.g., at the upper end of the annular portion of the male connector member.

IDENTIFICATION OF THE DRAWINGS

In order that the manner in which the foregoing and other objects are achieved according to the invention can be understood in detail, particularly advantageous embodiments thereof will be described with reference to the accompanying drawings, which form part of the original disclosure of this application, and wherein:

FIG. 3 is a view similar to FIG. 1 of a combined connector and flex joint according to another embodiment of the invention; and FIG. 4 is an enlarged fragmentary vertical sectional view showing details of a portion of the structure shown in FIG. 3.

THE EMBODIMENT OF FIGS. 1 AND 2

Figure 1:
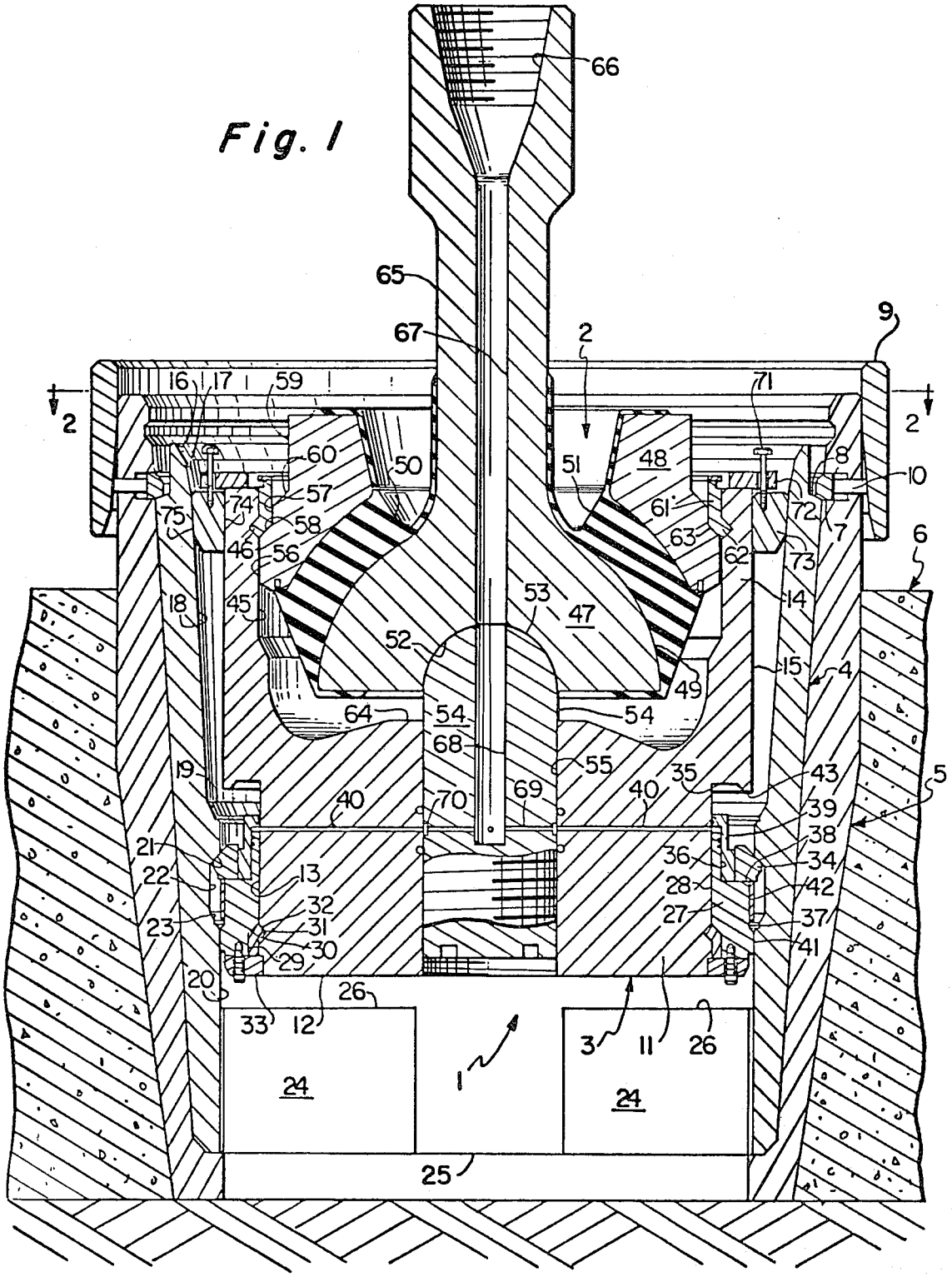
FIG. 1 is a vertical sectional view of a combined connector and flex joint for connecting the lower end of a string of pipe, forming part of a leg of a tension leg platform, to an anchoring base.
Figure 2:
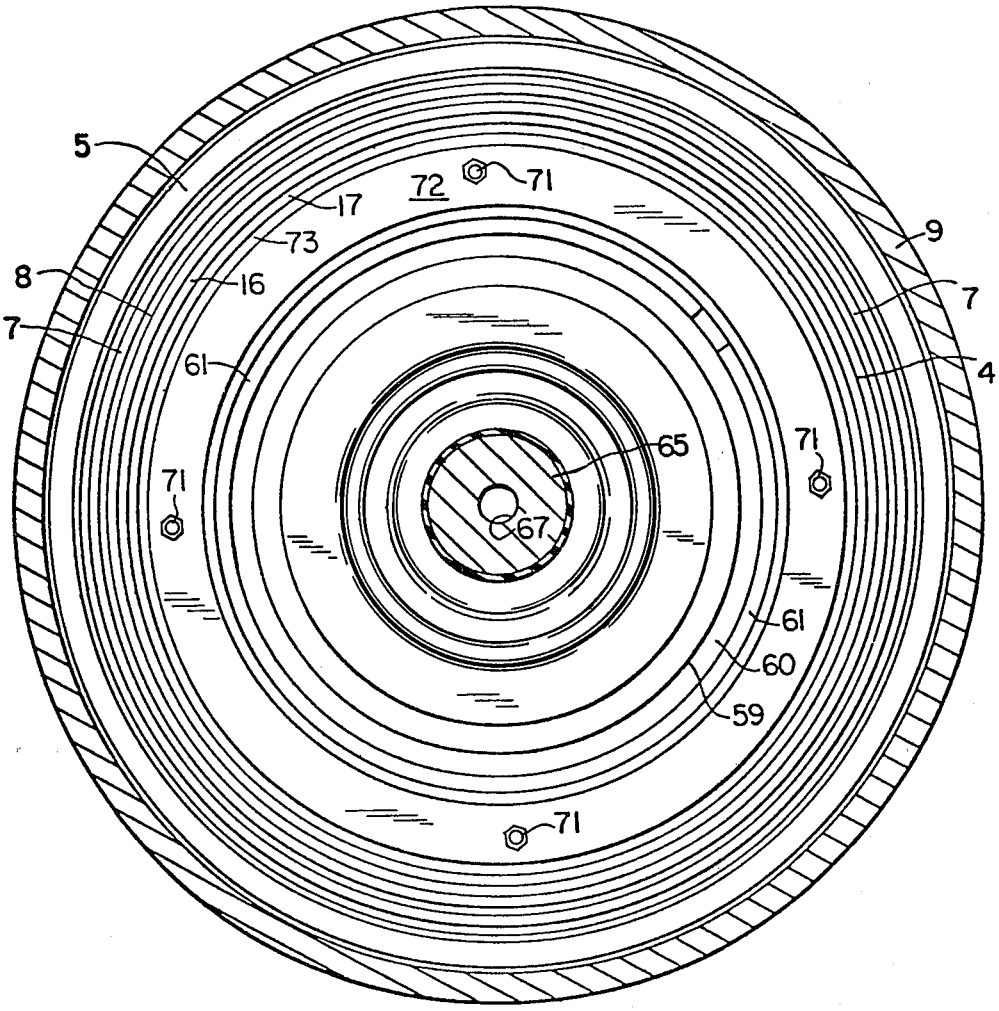
FIG. 2 is a transverse sectional view taken generally on line 2—2, FIG. 1.

The embodiment of the invention illustrated in FIGS. 1 and 2 comprises a remotely connectable and releasable connector, indicated generally at 1, combined with a flex joint, indicated generally at 2. Connector 1 is constructed generally in accordance with aforementioned application Ser. No. 170,970 and comprises a male connector member 3, shown landed and connected to the cooperating tubular female connector member 4, the latter being retained in a tubular receptacle 5 secured to the anchoring base 6 in any suitable fashion. The lower end of female member 4 is shouldered on receptacle 5, as shown, and the female member is locked in place, as by a split ring 7 forced inwardly to engage over a shoulder 8 on the female member by a camming ring 9 acting on push pins 10.

Male connector member 3 includes an integral main body 11 of metal, the body having a lower end 12, an intermediate portion having a right cylindrical outer surface portion 13, and an annular upper end portion 14 which presents a right cylindrical outer surface portion 15.

Female connector member 4 has at its upper end a short frustoconical inner surface portion 16 which tapers sharply downwardly and inwardly, a second frustoconical surface portion 17 tapering downwardly at a smaller angle than does portion 16, and a third frustoconical surface portion 18 tapering downwardly at a still smaller angle. Surface portion 18 is elongated and at its lower end joins a frustoconical guide surface 19 which tapers downwardly and inwardly at, e.g., 30° relative to the longitudinal axis of the connector. Surface 19 joins a right cylindrical inner surface 20 which extends to the lower end of female member 4. Below surface 19, surface 20 is interrupted by a transverse annular inwardly opening groove defined by an upper load-bearing shoulder 21, a cylindrical wall 22, and a lower frustoconical shoulder 23 which is identical to surface 19. Shoulder 21 is frustoconical, tapering upwardly and inwardly, advantageously at 45°. A predetermined distance below shoulder 23, surface 20 is interrupted by three splines 24 which are spaced apart circumferentially to define three guideways 25. Splines 24 have upper end shoulders 26 which lie in a common plane at right angles to the longitudinal axis of the coupling.

Outer surface portion 13 of body 11 is of substantially smaller diameter than is surface 20 of member 4 so that an annular body 27 can be accommodated between surfaces 13 and 20 when the parts are in the relative positions seen in FIG. 1. Body 27 has a right cylindrical inner surface 28 which slidably embraces surface 13. At its lower end, body 27 has a right cylindrical inner surface portion 29 and a frustoconical shoulder 30 which tapers upwardly and inwardly at 45° and joins surfaces 28 and 29. Body 11 has a transverse annular groove 31 which is of right triangular radial cross section so as to present a 45° frustoconical shoulder opposed to shoulder 30. A split ring 32 is engaged in groove 31 and has a 45° shoulder engaged by shoulder 30 to accept forces tending to move body 27 downwardly relative to body 11, relative movement in the opposite direction being prevented by a stop ring 33 bolted to the lower end of body 27 and shouldered on body 11, all as described in detail in aforementioned Patent 4,319,773.

Thus secured to main body 11, annular body 27 constitutes the male carrier for a split ring 34 of remotely operated connector means constructed in the manner described and claimed in aforementioned application Ser. No. 170,970. Body 27 is axially shorter than surface 13 so that there is a substantial space between the upper end of body 27 and the downwardly facing transverse annular shoulder 35 which joins surfaces 13 and 15. The upper end portion of body 27 has a right cylindrical outer surface 36 of substantially smaller diameter than surface 20. The remainder of body 27 has a larger right cylindrical outer surface 37, surfaces 36, 37 being concentric with surface 28 and joined by a flat transverse annular upwardly facing shoulder 38. Described in detail in application Ser. No. 170,970, ring 34 has upper and lower frustoconical outer surfaces to coact with shoulders 21 and 23, respectively, and a flat lower surface which can slidably engage shoulder 38, as seen in FIG. 1, so that ring 34 can be engaged between shoulders 21 and 38 to transfer tension loads from the male connector member to the female connector member. Ring 34 also has a right cylindrical inner surface, and when the resilient ring is in its relaxed and undistorted condition, substantially as seen in FIG. 1, that inner surface is spaced outwardly from surface 36. To prevent ring 34 from being cammed inwardly by interaction between the ring and shoulder 21 when the connector is under a tension load, an annular blocking piston 39 is provided which has a lower portion capable of filling the annular space between surface 36 and ring 34 when the parts are in the positions seen in FIG. 1. Piston 39 slidably embraces surfaces 13 and 36 and coacts with bodies 11 and 27 to define an expansible chamber to which pressure fluid can be supplied via ducts 40 to drive the piston upwardly, freeing ring 34 to move inwardly when the connector is to be released in the manners described in detail in application Ser. No. 170,970.

The diameter of surface 37 is smaller than that of surface 20 by an amount such that surface 37 can be embraced by female splines 24. However, in a location spaced below shoulder 38, surface 37 is interrupted by three arcuate, circumferentially spaced, outwardly projecting splines 41. Splines 41 are so dimensioned and positioned as to be capable of entering the respective guideways 25 only when body 27 is in one predetermined rotational position relative to female connector member 4. Between shoulder 38 and male splines 41, surface 37 is embraced by a retaining sleeve 42 employed during one mode of release of the coupling to retain ring 34 in a contracted position, achieved by coaction between ring 34 and shoulder 23, with the aid of a dependent annular camming lip 43, as the male connector member is moved downwardly with splines 41 registered with guideways 25.

Annular upper end portion 14 of male connector member 3 presents an axially elongated right cylindrical inner surface 45 interrupted near its upper end by a transverse annular inwardly opening groove 46 of right triangular radial cross section. Surrounded by surface 46, the flex joint 2 comprises a metal ball member 47 and a metal socket member 48. Member 47 has a convex spherical surface 49 and member 48 presents a concave spherical surface 50 of a larger radius of curvature than surface 49. Surfaces 49, 50 are spaced apart and the space therebetween is bridged by a body of elastomeric material 51 bonded to members 47, 48 in conventional fashion.

Member 47 also presents a downwardly opening concave spherical surface 52 which is concentric with surface 49 and dimensioned for flush sliding engagement with the convex spherical upper end surface 53 of a plug member 54 disposed in an axial bore 55 in main body 11 of male connector member 3. The lower end portions of plug member 54 and bore 55 are threaded so that the plug member can be retracted downwardly from the position shown in FIG. 1, preparatory to installation of members 47, 48.

Socket member 48 has a right cylindrical lower outer surface portion 56 of only slightly smaller diameter than inner surface 45 of portion 14 of body 11. Surface portion 56 is joined to a smaller diameter short cylindrical surface portion 57 by a frustoconical shoulder 58 which tapers upwardly and inwardly at 45°. Surface portion 57 is in turn joined to a still smaller diameter cylindrical surface portion 59 by upwardly and inwardly tapering shoulder 60. A split fastener ring 61 has a portion 62 of right triangular radial cross section engaged in groove 46, the fastener ring also presenting a frustoconical shoulder 63 which faces away from the upper wall of groove 46 and tapers upwardly and inwardly at the same angle as does that wall.

Below surface 45, body 11 is significantly recessed and includes a transverse upwardly directed surface 64 through which bore 55 opens. When the combination of members 47 and 48 is to be installed, plug member 54 is first retracted downwardly until, upon downward insertion of members 47 and 48, the lower end face of member 47 can be brought into contact with surface 64, bringing outer surface portion 57 of member 48 below groove 46. The resilient split fastener ring 61 is then retracted, inserted downwardly through the annular space between surfaces 45 and 59, and allowed to expand to its relaxed position, with portion 62 engaged in groove 46. Plug member 54 is then adjusted, via its threaded engagement in bore 55, until surfaces 52, 53 are engaged, shoulder 58 is engaged with shoulder 63, and elastomeric material 51 is under compression between members 47 and 48. With the parts thus interrelated, split fastener ring 61 serves to transfer tension loads from the flex joint to the male connector member in the manner more fully described in application Ser. No. 120,046, now U.S. Pat. No. 4,319,773.

Integral with member 47 is an upright stem 65 internally threaded at 66 for rigid attachment to the lowermost joint of the pipe string (not shown) to be connected to anchoring base 6. An axial bore 67 extends through member 47 and stem 66 to communicate between the bore of the pipe string and an axial blind bore 68 in plug 54. Near its blind end, bore 68 communicates with a plurality of radial bores 69 which open outwardly into a transverse annular outwardly opening groove 70 in the outer surface of plug member 54. With the plug member in its operative position, ducts 40 open inwardly into groove 70 and are thus in communication with the bore of the pipe string, via bores 67–69, so that pressure fluid supplied via the pipe string can operate to drive piston 39 to its uppermost position, freeing ring 34 to move inwardly and release the connector.

Surrounding upper end portion 14 of body 11, and loosely supported thereon by a circumferentially spaced series of bolts 71 extending freely through holes in a support ring 72 supported on the upper end of portion 14, is a wedge ring 73. Ring 73 has a right cylindrical inner surface 74 slidably embracing outer surface 15 of annular portion 14 of member 11. Outer surface 75 of ring 73 is frustoconical, tapering downwardly and inwardly at the same angle as does surface 18 of female member 4. When the combination of male connector member 3 and flex joint 2 is lowered into female connector member 4, outer surface 75 of ring 73 comes into sliding engagement with surface 18 of the female connector member and, as downward movement of the male connector member continues, becomes lightly wedged between surfaces 15 and 18 as ring 34 engages under shoulder 21. With the parts in these relative positions, the outer surfaces of male splines 41 are loosely embraced by surface 20, there being, e.g., a 0.005–0.02 inch space therebetween.

Once connector 1 has been made up as seen in FIG. 1, the entire tension load applied by the string of pipe connected to stem 65 is applied to female connector member 4, and hence to anchoring base 6, via split ring 34. When a lateral load is applied to the pipe string, a portion of the force from that load is transferred to annular portion 14 of body 11 via member 47, elastomeric material 51, member 48 and ring 61. The portion of the force thus applied to annular portion 14 is transferred to the upper portion of female connector member 4 via ring 73, in a location spaced well above ring 34. A portion of the force from the lateral load is also applied to the lower portion of body 11 via surfaces 52, 53 and plug member 54. This portion of the force causes one of male splines 41 to engage surrounding surface 20 of member 4, so that a portion of the force is applied to the female connector member in a location well below ring 34. The male connector member cannot be angularly displaced beyond that very small excursion allowed by the small annular spaced between male splines 41 and surface 20. Accordingly, while a portion of the force resulting from the lateral load is imparted to ring 34 via body 11, annular body 27 and blocking piston 39, this portion of the force can have at most a negligible tendency to disturb the engagement of ring 34, which carries the tension load, with shoulder 21.

Since member 47 is capable of pivoting on surface 53 of plug member 54, a lateral force applied to the pipe string to which stem 65 is attached can tend to cause body 11 of the male connector member to turn, about a horizontal axis, relative to the female connector member. Thus, if member 47 pivots to the right as viewed in FIG. 1, there is a resulting tendency for the upper end of body 11 to move to the left and the lower end to move to the right. But such movement of upper end portion 14 is immediately stopped by ring 73, while movement of the lower end is immediately stopped by engagement of one of the male splines 41 with surface 20. Accordingly, good direct transfer of forces from lateral loads to the female connector member, and thus to receptacle 5 and anchoring base 6, is achieved with a minimum possibility of adverse effect upon the tension load-carrying capacity of connector 1.

Since ring 72 is supported on but not secured to the upper end of annular upper end portion 14, the combination of male connector member 3 and flex joint 2 is free to be moved downwardly relative to female connector member 4 once male splines 41 have been aligned with the respective guideways 25 by manipulating the pipe string. Thus, wedging ring 73 does not interfere with secondary release of the connector in the manner described in application Ser. No. 170,970. Instead of the continuous ring 73, a plurality of circularly spaced arcuate wedge segments can be employed, each supported from ring 72 by one of the bolts 71. The upper end portion of surface 15, to be engaged by the inner surface of ring 73, can be frustoconical and taper upwardly and inwardly to increase the wedging action without reducing the freedom to move the male connector member downwardly for release.

THE EMBODIMENT OF FIGS. 3 AND 4

In this embodiment, male connector member 103 is in the form of a generally cup-shaped integral body comprising a transverse base 111 and an upstanding tubular portion 114. Female connector member 104 is an upstanding tubular member rigidly secured in any suitable fashion to tubular receptacle 105 which is in turn rigidly secured to the anchoring base 106. The bore of female member 104 includes an upper right cylindrical portion 116, an intermediate frustoconical portion 118 which tapers downwardly and inwardly, and a lower right cylindrical portion 120. At the juncture between portions 118 and 120, member 104 has a transverse annular inwardly opening groove 122 of right triangular radial cross section, the groove being defined by a frustoconical upper load-bearing wall 121, which tapers upwardly and inwardly at 45° relative to the axis of the bore, and a lower frustoconical wall 123 which tapers downwardly and inwardly. Flex joint 102 comprises a metal ball member 147, a metal socket member 148 and a metal plug member 154, the latter carried by base 111 of male member 103.

Member 147 presents an upwardly directed convex spherical surface 149. Member 148 presents a downwardly directed concave spherical surface 150 of larger radius of curvature than surface 149, the two spherical surfaces being spaced apart and the space therebetween being bridged by a body 151 of elastomeric material bonded to members 147, 148. Member 147 also presents a downwardly opening concave spherical surface 152 which is concentric with surface 149 and dimensioned for flush sliding engagement with the convex spherical upper end surface 153 of plug member 154. Plug member 154 is disposed in an axial bore 155 in base 111 of member 103 and provided with external threads engaged with the internal threads of bore 155.

Socket member 148 has a right cylindrical outer lower surface portion 156 embraced by inner surface portion 145 of portion 114 of member 103. Portion 156 is joined to a smaller diameter short right cylindrical surface portion 157 by a frustoconical shoulder 158 which tapers upwardly and inwardly at 45°. Portion 157 joins an upwardly and inwardly tapering frustoconical shoulder 160 which also tapers at 45°. Above shoulder 160, outer surface portion 159 tapers upwardly and inwardly at an angle smaller than 45°. Adjacent its upper end, inner surface 145 of portion 114 is interrupted by a transverse annular inwardly opening groove of right triangular radial cross section. A split fastener ring 161, constructed in accordance with U.S. Pat. No. 4,319,773, is engaged between shoulder 138 and the upper wall of the groove to transfer tension loads from socket member 148 to tubular portion 114.

Member 147 includes an upright stem 165 internally threaded at 166 for rigid attachment to the pipe string (not shown. An axial bore 167 extends through member 147 and stem 166 to communicate between the bore of the pipe string and an axial bore 168 through plug member 154.

At its upper end, annular portion 114 of member 103 has a flat transverse annular end face 144. Outer surface 115 of portion 114 is frustoconical, tapering downwardly and inwardly at the same angle as does portion 118 of the wall of the bore of female member 104. Rigidly secured to the upper end of portion 114, as by screws (not shown) engaged in threaded bores in fastener ring 161, is a carrier ring 177 having a right cylindrical outer surface 178, a flat annular bottom face 179, a frustoconical load-bearing shoulder 180 which tapers upwardly and inwardly from the inner periphery of bottom face 179 at 45°, and a frustoconical upper face 181 which tapers downwardly and inwardly at 45°. Shoulder 180 is disposed in flush engagement with shoulder 160, with the corner between shoulder 180 and upper face 181 engaged in the corner between shoulder 160 and surface 159.

As seen in FIG. 4, lower right cylindrical portion 120 of the female connector member extends upwardly to intersect lower wall 123 of groove 122. Right cylindrical outer surface 178 of ring 177 extends below lower wall 184 of groove 182 so that, when segments 186 are engaged in groove 122, the lower end portion of outer surface 178 of the ring is slidably embraced, as shown, by the upper end portion of surface portion 120.

Outer surface 178 of ring 177 is interrupted by a transverse annular groove 182, FIG. 4, which opens generally outwardly and downwardly and is defined by opposed frustoconical walls 183 and 184, which taper upwardly and inwardly at 45°, and an annular inner wall 185. This groove accommodates a plurality of arcuate segments 186 of rectangular radial cross section and dimensioned so that the segments can each lie in flush engagement with walls 121, 122 of the groove in female member 104 while still engaged in groove 182. For each segment 186, ring 177 is provided with a guide bore 187 which opens through inner wall 185 of groove 182 and bottom wall 188 of a threaded recess 189 which interrupts upper face 181.

A cylinder unit 190 is provided for each segment 186. Units 190 are identical, each comprising a cylinder barrel 191 closed at its respective ends by threaded end plugs 192, 103. Plug 192 has an outwardly projecting externally threaded extension 194 engaged in the corresponding recess 189 to secure unit 190 rigidly to ring 177, O-ring seals being provided at 195 and 196 to seal this end of the cylinder unit. Plug 192 has an axial through bore 197 which forms a continuation of the corresponding guide bore 187. A piston rod 198 has a lower portion 199 of larger diameter, extending through and slidably engaged in bores 187 and 197, the smaller diameter upper portion 200 of the rod extending upwardly through an axial through bore 201 in end plug 193. A centrally apertured piston 202 is seated against the shoulder presented by the juncture between rod portions 199, 200 and is secured to the rod, as by a nut 203. O-rings are provided at 204 and 205 to seal the piston and at 206 to seal between the piston rod and lower end plug 192. The lower end of rod portion 199 is threaded and engaged in a threaded bore in segment 186 to secure the segment rigidly to the rod. A helical compression spring 207 is engaged between piston 202 and upper end plug 193 to yieldably bias the combination of piston 202, rod 198 and segment 186 downwardly and outwardly to a position such that the segment can engage in groove 122 of female member 104, that position being determined by a stop nut 208 carried by the upper end of rod portion 200.

Pressure fluid is supplied to the space within barrel 191 below piston 202 via through bore 209 of plug 192, a duct 210 in ring 177, ducts 211 in the cup-shaped body of member 103, and conduits 212 connected to a hose 213 extending downwardly through bores 168, 167 and the bore of the pipe string to which the combined connector and flex joint is connected.

When the pipe string is to be connected to the anchoring base, female connector member 104 having already been installed, the pipe string and male connector member are run down, using conventional guide means, until male connector member 103 enters the female connector member. Preparatory to the trip down, hose 213 is vented, so that pressure fluid is exhausted from units 190 and springs 207 bias all of the segments 186 to their outer positions. As male connector member 103 descends through bore portion 118 of female connector member 104, segments 186 come into sliding engagement with the wall of bore portion 118, so that the male connector member is centered in the bore of the female member. As downward movement of the pipe string continues, segments 186 reach groove 122 of the female member and snap outwardly into that groove under the influence of springs 207. With the segments now engaging lower wall 123 of groove 122, dowhward movement is stopped. Application of an upward strain on the pipe string causes segments 186 to be engaged in compression between the lower wall 184 of groove 182 and the upper wall 121 of groove 122 so that the male member is locked in tension to the female member. When the pipe string is to be recovered, as for testing, the upward strain on the string is relieved and pressure fluid then supplied via hose 213 to drive pistons 202 upwardly and thus disengage segments 186 from groove 122.

What is claimed is:

1. In a device for connecting a string of pipe to an underwater anchoring base by manipulation of the string of pipe from an operational base at the surface of the body of water, the combination of a generally tubular female connector member adapted to be secured in upright position to the anchoring base and having
- an internal transverse annular generally downwardly directed load-bearing shoulder,
- a first annular inner surface portion located above the shoulder, and
- a second annular inner surface portion located below the shoulder;

a male connector member dimensioned for downward insertion into the female connector member, the male connector member comprising
- a body, and
- an annular portion rigidly connected to the body and projecting upwardly therefrom, the longitudinal axis of the annular portion being coincident with the longitudinal axis of the male connector member;

expansible and contractible load-bearing shoulder means carried by the male connector member and constructed and arranged to coact with the load-bearing shoulder of the female connector member when the male connector member has been inserted downwardly to a predetermined position in the female connector member,
- the expansible and contractible load-bearing shoulder means being generally annular and coxial with the upwardly projecting annular portion of the male connector member;

flex joint means comprising
- a rigid ball member having
  - a stem adapted to be connected to the string of pipe, and
  - a ball portion,
  - the ball member being disposed within the upwardly projecting annular portion of the male connector member with the ball portion spaced downwardly from the upper end of the annular upwardly projecting portion and the stem projecting upwardly through the annular portion, and
- a rigid socket member closely embraced by the upper end portion of the upwardly projecting annular portion of the male connector member;

fastener means engaged between the socket member and the upwardly projecting annular portion of the male connector member to restrain the socket member against upward movement relative to the male connector member,
- the flex joint means being constructed and arranged to transfer tension loads between the string of pipe and the male connector member via the ball member, the socket member and the fastener means; and generally annular rigid means carried by the male connector member and presenting an outwardly directed annular surface to be slidably embraced by at least one of the first and second inner surface portions of the female connector member when the male connector member has been inserted to said predetermined position in the female connector member.

2. The combination defined in claim 1, wherein the load-bearing shoulder means of the male connector member is located below the upwardly projecting annular portion of the male connector member; and said generally annular rigid means comprises a ring the outwardly directed annular surface of which is embraced by the first annular inner surface portion of the female connector member.

3. The combination defined in claim 1, wherein the load-bearing shoulder means of the male connector member is located at the upper end of the upwardly projecting annular portion of the male connector member; and said generally annular rigid means is carried by the upwardly projecting annular portion of the male connector member and presents an outwardly directed annular surface adjacent the load-bearing shoulder means of the male connector member.

4. The combination defined in claim 3, and further comprising a ring member carried by the upper end of the upwardly projecting annular portion of the male connector member, the load-bearing shoulder means of the male connector member being carried by the ring member, the ring member presenting said outwardly directed annular surface.

5. The combination defined in claim 4, wherein the transverse annular generally downwardly directed load-bearing shoulder of the female connector member is the upper wall of an inwardly opening groove;

the second annular inner surface portion of the female connector member extends upwardly to said groove and is right cylindrical adjacent said groove; and the outer surface of the ring member includes a lower end portion located below the load-bearing shoulder means of the male connector member, said lower end portion constituting said outwardly directed annular surface and being slidably embraced by the portion of the second annular inner surface portion of the female connector member adjacent said groove.

6. The combination defined in claim 4, wherein the upwardly projecting annular portion of the male connector member has an upwardly directed end face;

the rigid socket member of the flex joint means has a frustoconical upper surface portion disposed inwardly of said end face; and the ring member comprises a first annular surface seated on the end face of the upwardly projecting annular portion of the male connector member, and a second annular surface seated on the frustoconical upper surface portion of the rigid socket member of the flex joint means.

7. The combination defined in claim 1, wherein the ball member and socket member present opposed spherical surfaces, and the flex joint means further comprises elastomeric means operatively disposed between the spherical surfaces of the ball member and the socket member;

the body of the male connector member has an axial through bore and the male connector member further comprises a plug member disposed within said through bore and projecting thereabove, the upper end of the plug member constituting a convex spherical bearing surface, the plug member being adjustable axially with respect to the body of the male connector member; and the ball member has a central downwardly opening concave spherical bearing surface engaged with the convex spherical bearing surface of the plug member.

8. The combination defined in claim 7, wherein the plug member is a rigid member having external threads engaged with internal threads in the through bore.

9. The combination defined in claim 1, wherein the rigid ball member has an axial through bore for communication with the bore of the pipe string;

the body of the male connector member has a central bore and the male connector member further comprises a rigid member secured in the central bore of the body and having an upwardly exposed convex spherical bearing surface engaged by a downwardly directed concave spherical bearing surface on the ball member, the rigid member having an axial bore communicating with the through bore of the ball member;

the combination further comprising pressure-fluid operated release means for releasing the load-bearing shoulder means, and pressure fluid supply means interconnecting the release means and said axial bore of the rigid member secured in the central bore of the body.

10. In a device for connecting a string of pipe to an underwater anchoring base by manipulation of the string of pipe from an operational base at the surface of the body of water, the combination of a generally tubular female connector member adapted to be secured in upright position to the anchoring base and having a transverse annular generally downwardly directed load-bearing shoulder, a first annular inner surface portion located above the soulder, and a second annular inner surface portion located below the shoulder;

a male connector member comprising a main body having a lower end portion, an intermediate portion, and an upwardly projecting annular upper end portion;

connector means carried by the intermediate portion of the main body of the male connector member and comprising annular stop means constructed and arranged to coact with the load-bearing shoulder of the female connector member to prevent upward movement of the male connector member relative to the female connector member;

flex joint means comprising a first rigid member disposed in the annular upper end portion of the main body of the male connector member and having a central upstanding stem for connection to the string of pipe, and a lower portion rigidly connected to the stem and presenting an annular upwardly directed convex surface concentric with the stem, and an annular second rigid member surrounded by the annular upper end portion of the male connector member and having a downwardly directed concave surface opposed to the convex surface of the first rigid member, the second rigid member being secured to the annular upper end portion of the male connector member against upward movement relative thereto;

first generally annular rigid means surrounding the upper end portion of the body of the male connector member and dimensioned to at least substantially fill the space between the upper end portion of the male connector member and the first annular inner surface portion of the female connector member when the annular stop means is engaged with the load-bearing shoulder; and second generally annular rigid means surrounding the body of the male connector member and dimensioned to substantially fill the annular space between the body of the male connector member and the second annular inner surface portion of the female connector member when the annular stop means is engaged with the load-bearing shoulder.

11. The combination defined in claim 10, wherein the lower-portion of the first rigid member of the flex joint means has downwardly directed pivot bearing means centered with respect to the longitudinal axis of the upstanding stem, and the body of the male connector member has upwardly directed centrally located pivot bearing means engaged with the downwardly directed pivot bearing means of the first rigid member of the flex joint means.

12. The combination defined in claim 11, wherein the flex joint means further comprises elastomeric means operatively disposed between the convex surface of the first rigid member and the concave surface of the second rigid member.

13. The combination defined in claim 10, wherein the first generally annular rigid means surrounding the upper end portion of the body of the male connector member is a metal ring.

14. The combination defined in claim 10, wherein the first annular inner surface portion of the female connector member is frustoconical and tapers downwardly and inwardly; and the first generally annular rigid means has a frustoconical outer surface tapering downwardly and inwardly at substantially the same angle as the first annular inner surface portion of the female connector member.

15. The combination defined in claim 14, wherein the annular upper end portion of the body of the male member has a cylindrical outer surface, and the first generally annular rigid means has a generally cylindrical inner surface slidably engaged with the outer surface of the annular upper end portion of the male connector body, whereby the combination of the male connector member and the flex joint means can be moved downwardly relative to the female connector member.

16. The combination defined in claim 10, wherein the second generally annular rigid means comprises an annular body embracing the main body of the male connector member and carrying the annular stop means; and a circumferentially spaced series of male splines dimensioned and disposed to pass through guideways defined by a plurality of female splines on the female connector member.

17. In a device for connecting a string of pipe in tension to an underwater anchoring base, the combination of a generally tubular female connector member adapted to be secured in upright position to the anchoring base and having a transverse annular generally downwardly directed load-bearing shoulder, and an annular surface portion located above the load-bearing shoulder;

a male connector member having a main body dimensioned for downward insertion into the female connector member, the body of the male connector member having an upwardly projecting annular portion defining an upwardly opening cavity;

flex joint means disposed within said upwardly opening cavity and comprising a rigid ball member adapted for connection to the string of pipe, and a rigid socket member embraced by the upwardly projecting annular portion of the male connector member;

fastener means rigidly securing the socket member of the flex joint means to the upwardly projecting annular portion of the male connector member to restrain the socket member from upward movement relative to the male connector member;

annular stop means carried by the male connector member in a location below the upwardly projecting annular portion of the male connector member and capable of engaging beneath the load-bearing shoulder of the female connector member to secure the male connector member against upward movement relative to the female connector member;

rigid generally annular means embracing the upper end portion of the upwardly projecting annular portion of the body of the male connector member and closely embraced by said annular surface portion of the female connector member to at least limit lateral movement of the upper end portion of the body of the male connector member relative to the female connector member when the annular stop means is engaged with the load-bearing shoulder.

* * * * *